US009890781B2

(12) United States Patent
Schmid et al.

(10) Patent No.: US 9,890,781 B2
(45) Date of Patent: Feb. 13, 2018

(54) INTERNAL GEAR PUMP FOR A HYDRAULIC VEHICLE BRAKE SYSTEM AND METHOD FOR PRODUCING THE INTERNAL GEAR PUMP

(71) Applicant: Robert Bosch GmbH, Stuttgart (DE)

(72) Inventors: Joachim Schmid, Filderstadt (DE); Klaus Meyer, Ditzingen (DE); Julius Nemzov, Esslingen (DE); Karl-Heinz Hach, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 193 days.

(21) Appl. No.: 15/013,026

(22) Filed: Feb. 2, 2016

(65) Prior Publication Data

US 2016/0222962 A1 Aug. 4, 2016

(30) Foreign Application Priority Data

Feb. 2, 2015 (DE) ..... 10 2015 201 727

(51) Int. Cl.
*F04C 2/10* (2006.01)
*F04C 2/08* (2006.01)

(52) U.S. Cl.
CPC ..... *F04C 2/101* (2013.01); *F04C 2/084* (2013.01)

(58) Field of Classification Search
CPC ..... F04C 2/084; F04C 2/086; F04C 2/101; F04C 2/102; F04C 2/18; F04C 15/0026; F01C 1/084
USPC ..... 418/169, 191
See application file for complete search history.

(56) References Cited

U.S. PATENT DOCUMENTS 6,939,093 B2 * 9/2005 Arvin ..... B23F 19/104 407/23
6,974,012 B2 * 12/2005 Rau ..... B22F 5/08 192/108
7,377,731 B1 * 5/2008 Arvin ..... B23F 19/12 409/11
2003/0183479 A1 * 10/2003 Rau ..... B22F 5/08 192/108

FOREIGN PATENT DOCUMENTS

DE 10 2013 201 384 A1 7/2014

* cited by examiner

*Primary Examiner* — Mark Laurenzi
*Assistant Examiner* — Dapinder Singh
(74) *Attorney, Agent, or Firm* — Maginot, Moore & Beck LLP

(57) ABSTRACT

An internal gear pump for a hydraulic vehicle brake system includes a pump shaft, a pinion, a ring gear, a first axial plate, and a second axial plate. The pinion is disposed on the pump shaft, is configured to rotate conjointly therewith, and is arranged eccentrically within the ring gear so as to mesh therewith. The first and second axial plates are adjacent to the pinion and the ring gear. A toothing on at least one of the ring gear and the pinion is configured such that an axial width of a root of a respective tooth is greater than an axial width of a crest of the respective tooth. A corresponding method relates to producing such an internal gear pump.

11 Claims, 7 Drawing Sheets

INTERNAL GEAR PUMP FOR A HYDRAULIC VEHICLE BRAKE SYSTEM AND METHOD FOR PRODUCING THE INTERNAL GEAR PUMP

This application claims priority under 35 U.S.C. § 119 to patent application no. DE 10 2015 201 727.3, filed on Feb. 2, 2015 in Germany, the disclosure of which is incorporated herein by reference in its entirety.

The disclosure relates to an internal gear pump for a hydraulic vehicle brake system. The disclosure furthermore relates to a method for producing the internal gear pump.

BACKGROUND

Modern brake-assistance and driving dynamics systems almost exclusively use oscillating positive displacement pumps as high pressure generating unit. Leakage passes over a circumference of a piston and along a guide length in a stationary cylinder.

Rotating positive displacement pumps have axial and radial leakage gaps between individual chambers of the displacement gear components. Internal gear pumps have leakage gaps for example axially on the end sides of the gear wheels, i.e. of the pinion and of the ring gear. This results in a conflict of objectives between minimal leakage and minimal friction of the rotating positive displacement pump.

DE 10 2013 201 384 A1 discloses an internal gear pump for a hydraulic vehicle brake system, having a pump shaft on which a pinion is arranged for conjoint rotation, having a ring gear which meshes with the pinion, and having a rotationally fixed axial disk which is arranged on and bears in a sealing manner against an end side of the pinion and of the ring gear.

SUMMARY

The present disclosure creates an internal gear pump for a hydraulic vehicle brake system, having a pump shaft on which a pinion is arranged for conjoint rotation, having a ring gear, wherein the pinion is arranged eccentrically in the ring gear and meshes with the ring gear, having a first axial plate which is arranged on a first end side of the pinion and of the ring gear, and having a second axial plate which is arranged on a second end side of the pinion and of the ring gear, wherein the first axial plate and the second axial plate delimit a pump chamber in the axial direction, wherein a toothing on the pinion and/or on the ring gear is configured such that an axial width of a tooth root of a respective tooth is configured to be greater than an axial width of a tooth crest of the respective tooth.

The present disclosure furthermore creates a method for producing an internal gear pump for a hydraulic vehicle brake system. The method comprises providing a pump shaft. In addition, the method comprises arranging a pinion on the pump shaft for conjoint rotation. The method moreover comprises arranging a ring gear eccentrically relative to the pinion on the pump shaft, wherein the pinion meshes with the ring gear. The method additionally comprises arranging a first axial plate on the pump shaft on a first end side of the pinion and of the ring gear. The method furthermore comprises arranging a second axial plate on the pump shaft on a second end side of the pinion and of the ring gear, wherein the first axial plate and the second axial plate delimit a pump chamber in the axial direction, wherein a toothing on the pinion and/or on the ring gear is configured such that an axial width of a tooth root of a respective tooth is configured to be greater than an axial width of a tooth crest of the respective tooth.

It is an idea of the present disclosure to increase the mechanical and hydraulic efficiency and also the service life of an internal gear pump. In the internal gear pump according to the disclosure, friction occurs between gear wheels and axially abutting plates that compensate for a leakage gap. This friction is reduced in that the axial width of the tooth root of a respective tooth is configured to be greater than an axial width of a tooth crest of the respective tooth on the pinion and/or on the ring gear. In this way, the internal gear pump can be operated in a fluid friction mode in operation. Advantageous embodiments and developments can be gathered from the claims and from the description with reference to the figures.

According to a preferred development, provision is made for an end-side surface of respective tooth flanks and/or tooth crest faces of the toothing on the pinion and/or on the ring gear to be configured in an at least partially convex manner. In this way, the solid contact pressure between the pinion and/or the ring gear and the axial plates abutting in each case in a sealing manner can be minimized.

According to a further preferred development, provision is made for a height of a convexity of the end-side surface of respective tooth flanks and/or tooth crest faces of the toothing on the pinion and/or on the ring gear to be between 10 nm and 1 mm. This allows a minimum lubrication gap height. Furthermore, when the internal gear pump is started up and shut down and when it runs down, solid body friction and/or mixed friction that occurs as a matter of principle can already be replaced with fluid friction at low pump speeds. In this way, the reliability can be increased considerably, in particular in vehicle applications having for example a high proportion of starting/stopping and/or when coasting.

According to a further preferred development, provision is made for the end-side surface of the respective tooth flanks and/or of the tooth crest faces of the toothing on the pinion and/or on the ring gear to be configured as a freeform surface in the form of at least one spline or as a geometrically defined surface conically, cylindrically or as a logarithmically profiled form. The design of the above-described geometrically topographical structures allows the solid contact pressure and as a result the operation of the internal gear pump in the fluid friction range to be minimized. As a result of a reduction in the mechanical friction of the pump, the required drive power is lowered substantially. A leakage flow between the components is advantageously reduced. Furthermore, the reliability of the components can be increased by the dominant proportion of fluid friction.

According to a further preferred development, provision is made for a surface of the first axial plate and/or of the second axial plate to be configured, at least in a region adjacent to the toothing on the pinion and/or on the ring gear, as a freeform surface in the form of at least one spline or as a geometrically defined surface conically, cylindrically or as a logarithmically profiled form. In this way, in addition to a modification of the tooth flanks and/or tooth crest faces of the toothing on the pinion and/or on the ring gear, further hydrodynamic effects can be created and thus the mechanical friction in the internal gear pump can additionally be reduced.

According to a further preferred development, provision is made for a length of the end-side surface of the tooth flanks and/or of the tooth crest faces of the toothing on the pinion and/or on the ring gear to be from 10 μm to 1 mm. This allows a minimum lubrication gap height. Furthermore, when the internal gear pump is started up and shut down and when it runs down, solid body friction and/or mixed friction that occurs as a matter of principle can already be replaced with fluid friction at low pump speeds. In this way, the reliability is increased considerably, in particular in vehicle applications having for example a high start/stop proportion and/or when coasting.

According to a further preferred development, provision is made for the end-side surface of respective tooth flanks and/or tooth crest faces of the toothing on the pinion and/or on the ring gear to be formed by lapping, grinding, turning and/or turn milling. In this way, the surface of the tooth flanks and/or of the tooth crest faces of the toothing on the pinion and/or on the ring gear can be machined such as to allow the solid contact pressure in the internal gear pump to be minimized.

According to a further preferred development, provision is made for the first axial plate and the second axial plate each to be configured as a disklike plate embodied in a one-part or multipart manner. In this way, the first and the second axial plate can be adapted in an advantageous manner to the respective structural requirements placed on the internal gear pump.

According to a further preferred development, provision is made for the end-side surface of respective tooth flanks and/or tooth crest faces of the toothing on the pinion and/or on the ring gear to be formed by lapping, grinding, turning and/or turn milling. In this way, the surface of the tooth flanks and/or of the tooth crest faces of the toothing on the pinion and/or on the ring gear can be machined such as to allow the solid contact pressure in the internal gear pump to be minimized.

The described configurations and developments can be combined with one another as desired.

Further possible configurations, developments and implementations of the disclosure also comprise combinations, not explicitly mentioned, of features of the disclosure that are described above or in the following text with regard to the exemplary embodiments.

BRIEF DESCRIPTION OF THE DRAWINGS

The accompanying drawings are intended to convey further understanding of the embodiments of the disclosure. They illustrate embodiments and serve, in conjunction with the description, to explain principles and concepts of the disclosure.

Other embodiments and many of the advantages mentioned can be gathered with regard to the drawings. The illustrated elements of the drawings are not necessarily shown true to scale with respect to one another.

In the drawings:

FIG. 1 shows an exploded illustration of an internal gear pump for a hydraulic vehicle brake system according to a preferred embodiment of the disclosure;

FIG. 2 shows a schematic illustration of a pinion of the internal gear pump according to the preferred embodiment of the disclosure;

FIG. 3 shows a cross-sectional view of the pinion shown in FIG. 2 according to the preferred embodiment of the disclosure;

FIG. 4 shows a view in longitudinal section of the internal gear pump in the mounted state according to the preferred embodiment of the disclosure;

FIG. 5 shows a schematic illustration of the pinion of the internal gear pump according to a further embodiment of the disclosure;

FIG. 6 shows a cross-sectional view of the pinion of the internal gear pump according to the further preferred embodiment of the disclosure;

FIG. 7 shows a schematic illustration of a ring gear of the internal gear pump according to the further preferred embodiment of the disclosure;

FIG. 8 shows a cross-sectional view of the ring gear of the internal gear pump according to the further preferred embodiment of the disclosure;

FIG. 9 shows a view in longitudinal section of the internal gear pump in the mounted state according to the further preferred embodiment of the disclosure; and FIG. 10 shows a flow chart of a method for producing an internal gear pump for a hydraulic vehicle brake system according to the preferred embodiment of the disclosure.

DETAILED DESCRIPTION

In the figures of the drawings, identical reference signs denote identical or functionally identical elements, parts or components, unless stated to the contrary.

Figure 1:
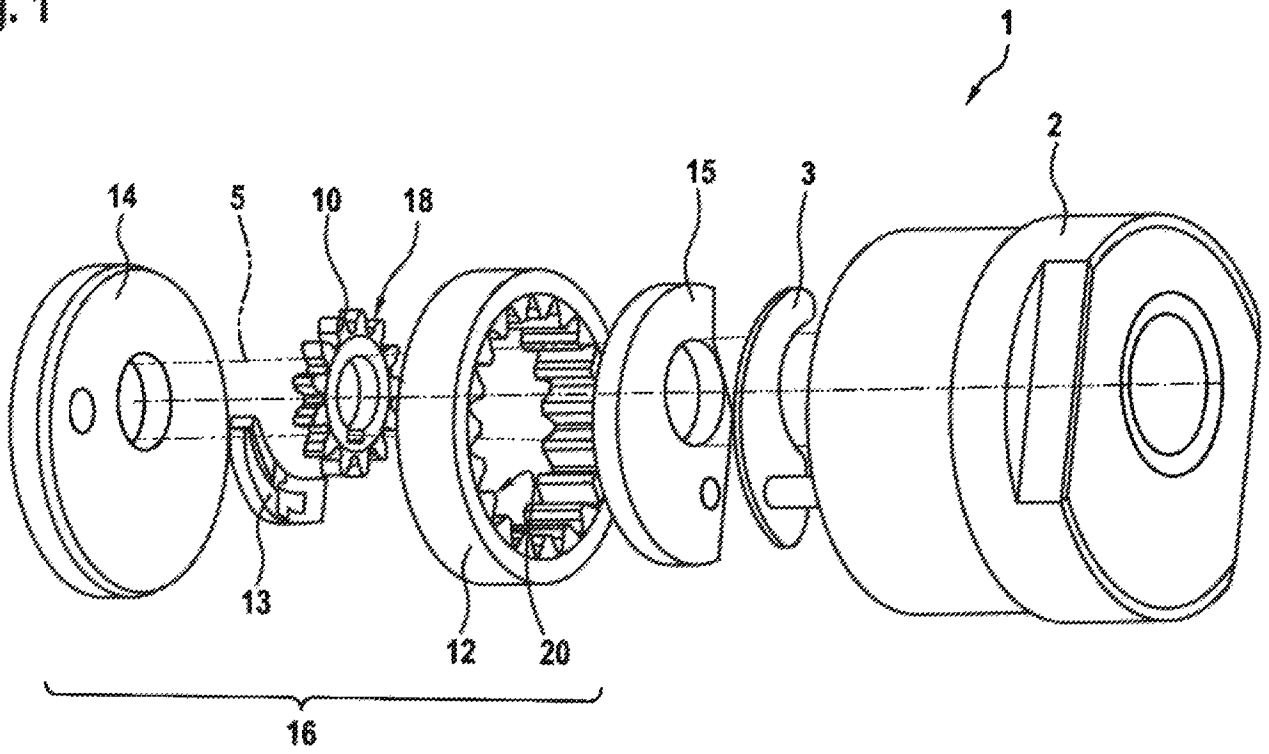

FIG. 1 shows an exploded illustration of an internal gear pump for a hydraulic vehicle brake system according to a preferred embodiment of the disclosure.

The internal gear pump 1 has a housing 2, a sealing ring 3, a pump shaft 5, a pinion 10, a ring gear 12, a crescent 13, a first axial plate 14 and a second axial plate 15. The pump shaft 5 is arranged so as to extend through the first axial plate 14, the pinion 10, the ring gear 12, the second axial plate 15 and the housing 2.

The pinion 10 is arranged on the pump shaft 5 for conjoint rotation. The pinion 10 is arranged (in a mounted state, not shown in FIG. 1, of the internal gear pump) eccentrically in the ring gear 12 and meshes with the latter. The crescent 13 is likewise arranged eccentrically in the ring gear 12, in particular between the pinion 10 and an inner circumference of the ring gear 12. The pinion 10 has a toothing 18 on an outer circumference. The ring gear 12 has a toothing 20 on an inner circumference. The toothing 18 on the pinion 10 is configured such that it is suitable for meshing with the toothing 20 on the ring gear 12. The first axial plate 14 is arranged on a first end side of the pinion 10 and of the ring gear 12 and bears against them in a sealing manner. The second axial plate 15 is arranged on a second end side of the pinion 10 and of the ring gear 12 and bears against them in a sealing manner. The first axial plate 14, the pinion 10, the ring gear 12, the crescent 13 and the second axial plate 15 form a pump chamber 16.

Figure 2:
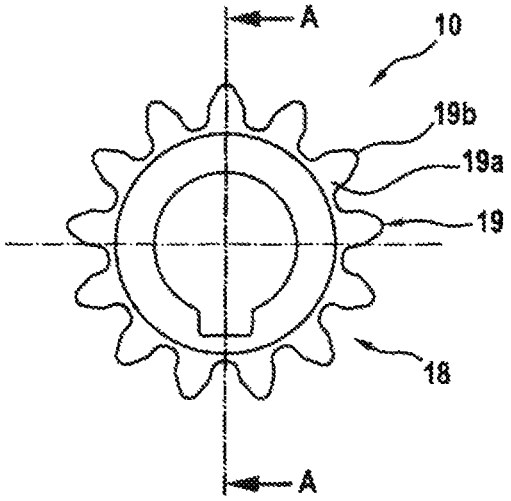

FIG. 2 shows a schematic illustration of a pinion of the internal gear pump according to the preferred embodiment of the disclosure. The pinion 10 preferably has the toothing 18 formed on an outer circumference of the pinion 10. A respective tooth 19 of the toothing 18 on the pinion 10 has a tooth root 19*a* and a tooth crest 19*b*.

Figure 3:
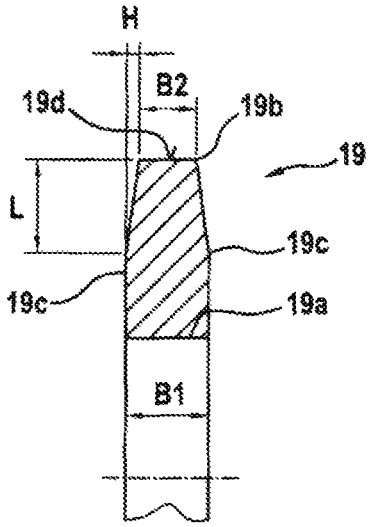

FIG. 3 shows a cross-sectional view of the pinion shown in FIG. 2 according to the preferred embodiment of the disclosure. The tooth 19 has the tooth root 19*a*, the tooth crest 19*b*, respective tooth flanks 19*c* and a tooth crest face 19*d*. The tooth 19 preferably has a predetermined geometric shape which is configured such that an axial width B1 of the tooth root 19*a* is configured to be greater than an axial width B2 of the tooth crest 19*b*.

The tooth flanks 19*c* of the tooth 19 are preferably beveled in the present embodiment. A height H of the slope of the respective tooth flanks 19*c* is preferably between 10 nm and 1 mm. A length L of the end-side surface of the respective tooth flanks 19*c* is preferably between 10 μm and 1 mm. The tooth crest face 19*d* of the tooth 19 is configured in a planar manner in the present embodiment.

Figure 4:
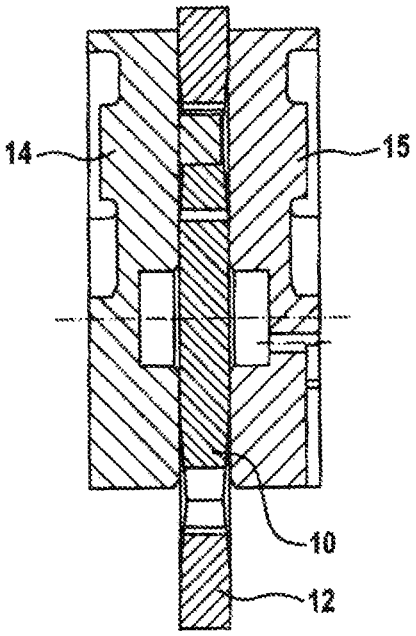

FIG. 4 shows a view in longitudinal section of the internal gear pump in the mounted state according to the preferred embodiment of the disclosure. The pinion 10 is preferably arranged eccentrically in the ring gear 12 and meshes with the latter. The first axial plate 14 is arranged on a first end side of the pinion 10 and of the ring gear 12. The second axial plate 15 is arranged on a second end side of the pinion 10 and of the ring gear 12. The first axial plate 14 and the second axial plate 15 each bear in a sealing manner against the pinion 10 and the ring gear 12.

Figure 5:
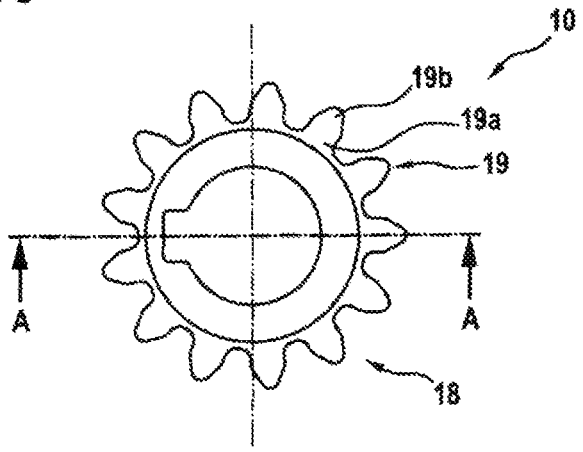

FIG. 5 shows a schematic illustration of the pinion of the internal gear pump according to a further preferred embodiment of the disclosure. The pinion 10 preferably has the toothing 18 formed on an outer circumference of the pinion 10. A respective tooth 19 of the toothing 18 on the pinion 10 has a tooth root 19*a* and a tooth crest 19*b*.

Figure 6:
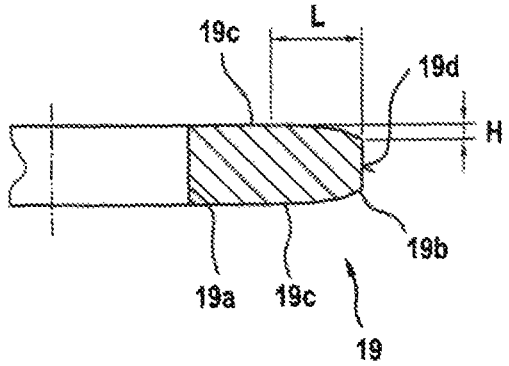

FIG. 6 shows a cross-sectional view of the pinion of the internal gear pump according to the further preferred embodiment of the disclosure. The tooth 19 has the tooth root 19*a*, the tooth crest 19*b*, respective tooth flanks 19*c* and a tooth crest face 19*d*. An end-side surface of the respective tooth flanks 19*c* of the tooth 19 are configured in a partially convex manner in the present embodiment. A length L of the end-side surface of the tooth flanks 19*c* is preferably between 10 μm and 1 mm.

A height H of a convexity of the end-side surface of the respective tooth flanks 19*c* is preferably between 10 nm and 1 mm. Alternatively, the length L of the end-side surface of the respective tooth flanks 19*c* and the height H of the convexity of the end-side surface of the respective tooth flanks 19*c* can also have another suitable dimension.

Alternatively to the convex shaping, the respective tooth flanks 19*c* of the tooth 19 can be configured for example as a freeform surface in the form of at least one spline or as a geometrically defined surface conically, cylindrically or as a logarithmically profiled form.

Figure 7:
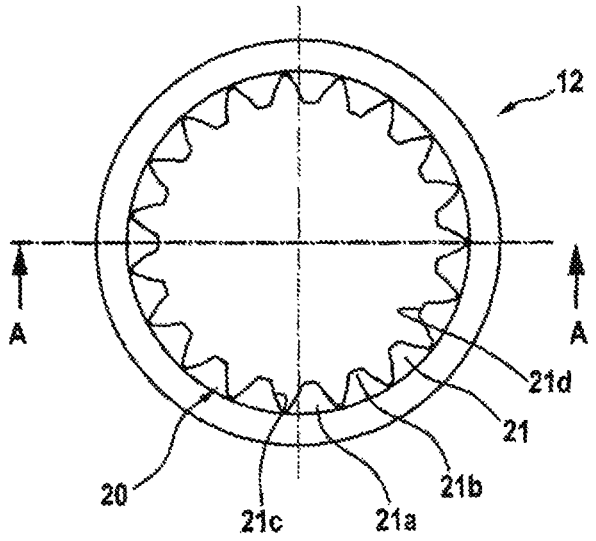

FIG. 7 shows a schematic illustration of a ring gear of the internal gear pump according to the further preferred embodiment of the disclosure. The ring gear 12 has the toothing 20 on an inner circumference. Respective teeth 21 of the toothing 20 each have a tooth root 21*a*, a tooth crest 21*b*, respective tooth flanks 21*c* and a tooth crest face 21*d*.

Figure 8:
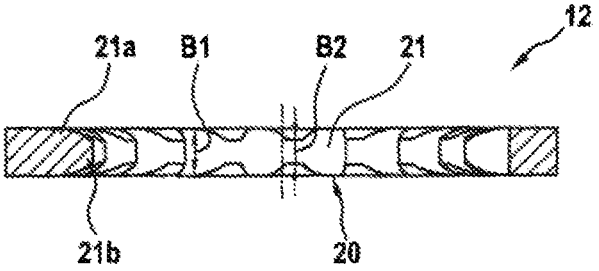

FIG. 8 shows a cross-sectional view of the ring gear of the internal gear pump according to the further preferred embodiment of the disclosure.

The ring gear 12 preferably has the toothing 20. An axial width B1 of the tooth root 21*a* of the respective tooth 21 is preferably configured to be greater than an axial width B2 of a tooth crest 21*b* of the respective tooth 21.

In the present embodiment, the end-side surface of respective tooth flanks 21*c* of the toothing 20 on the ring gear 12 is preferably configured in a partially convex manner. A height H of a convexity of the end-side surface of respective tooth flanks 21*c* of the toothing 20 on the ring gear 12 is preferably between 10 nm and 1 mm. A length L of the end-side surface of the tooth flanks 21*c* of the toothing 20 on the ring gear 12 is preferably between 10 μm and 1 mm.

Alternatively to the partially convex configuration of the end-side surface of respective tooth flanks 21*c* of the toothing 20 on the ring gear 12, said surface can be configured for example as a freeform surface in the form of at least one spline or as a geometrically defined surface conically, cylindrically or as a logarithmically profiled form.

The end-side surface of respective tooth flanks 19*c*, 21*c* and/or tooth crest faces 19*d*, 21*d* of the toothing 18, 20 on the pinion 10 and/or on the ring gear 12 is preferably formed by lapping, grinding, turning and/or turn milling.

Figure 9:
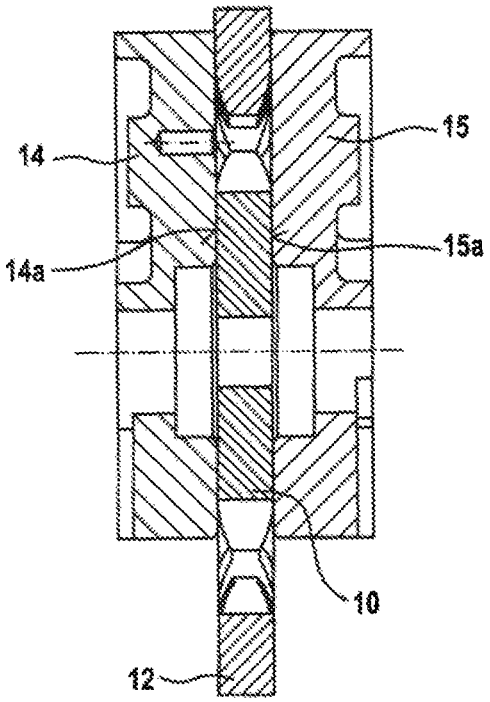

FIG. 9 shows a view in longitudinal section of the internal gear pump in the mounted state according to the further preferred embodiment of the disclosure. The pinion 10 is preferably arranged eccentrically in the ring gear 12 and meshes with the latter. The first axial plate 14 is arranged on a first end side of the pinion 10 and of the ring gear 12. The second axial plate 15 is arranged on a second end side of the pinion 10 and of the ring gear 12. The first axial plate 14 and the second axial plate 15 each bear in a sealing manner against the pinion 10 and the ring gear 12.

The first axial plate 14 and the second axial plate 15 are preferably configured in a one-part manner. Alternatively, the first axial plate 14 and the second axial plate 15 can also be configured in a multipart manner.

In addition, a surface 14*a*, 15*a* of the first axial plate 14 and/or of the second axial plate 15 can be configured, in a region adjacent to the toothing 18, 20 on the pinion 10 and/or on the ring gear 12, as a freeform surface in the form of at least one spline or as a geometrically defined surface conically, cylindrically or as a logarithmically profiled form.

The geometrically defined surfaces or topographical configurations can preferably be oriented in one and/or a plurality of directions.

Figure 10:
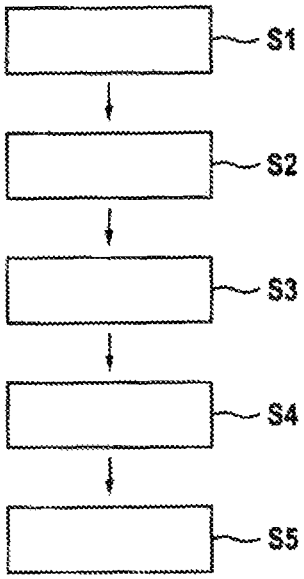

FIG. 10 shows a flow chart of a method for producing an internal gear pump for a hydraulic vehicle brake system according to the preferred embodiment of the disclosure.

The method comprises providing S1 a pump shaft. In addition, the method comprises arranging S2 a pinion on the pump shaft for conjoint rotation. The method moreover comprises arranging S3 a ring gear eccentrically relative to the pinion on the pump shaft, wherein the pinion meshes with the ring gear. The method additionally comprises arranging S4 a first axial plate on the pump shaft on a first end side of the pinion and of the ring gear. The method furthermore comprises arranging S5 a second axial plate on the pump shaft on a second end side of the pinion and of the ring gear, wherein the first axial plate and the second axial plate delimit a pump chamber in the axial direction, wherein a toothing on the pinion and/or on the ring gear is configured such that an axial width of a tooth root of a respective tooth is configured to be greater than an axial width of a tooth crest of the respective tooth.

An end-side surface of respective tooth flanks and/or tooth crest faces of the toothing on the pinion and/or on the ring gear are preferably configured in an at least partially convex manner.

The end-side surface of the respective tooth flanks and/or of the tooth crest faces of the toothing on the pinion and/or on the ring gear is preferably configured as a freeform surface in the form of at least one spline or as a geometrically defined surface conically, cylindrically or as a logarithmically profiled form.

A surface of the first axial plate and/or of the second axial plate is preferably configured, at least in a region adjacent to the toothing on the pinion and/or on the ring gear, as a freeform surface in the form of splines or as a geometrically defined surface conically, cylindrically or as a logarithmically profiled form.

The first axial plate and the second axial plate are preferably each configured as a disklike plate embodied in a one-part or multipart manner.

The end-side surface of respective tooth flanks and/or tooth crest faces of the toothing on the pinion and/or on the ring gear is preferably formed by lapping, grinding, turning and/or turn milling.

Although the present disclosure has been described here with reference to preferred exemplary embodiments, it is not limited thereto but is modifiable in a wide variety of ways. In particular, the disclosure can be altered or modified in various ways without departing from the essence of the disclosure.

For example, the end-side surface of respective tooth flanks of the toothing on the ring gear can alternatively be beveled analogously to the preferred embodiment of the pinion. The slope is preferably constant and has a predetermined inclination. Alternatively to the provision of an internal gear pump, the present disclosure is also applicable for example to an external gear pump or gerotor pump.

What is claimed is:

1. An internal gear pump for a hydraulic vehicle brake system, comprising:

a pump shaft;

a pinion positioned on the pump shaft and configured to rotate conjointly therewith;

a ring gear positioned eccentrically with the pinion so as to mesh therewith;

a first axial plate positioned on a first end side of the pinion and ring gear; and a second axial plate positioned a second end side of the pinion and ring gear, the first axial plate and second axial plate delimiting a pump chamber in an axial direction;

wherein at least one of the pinion and the ring gear includes a toothing configured such that an axial width of a root of a respective tooth is greater than an axial width of a crest of the respective tooth.

2. The internal gear pump according to claim 1, wherein at least one of an end-side surface and a crest face of the respective tooth is at least partially convex.

3. The internal gear pump according to claim 2, wherein a height of a convexity of the at least one of an end-side surface and a crest face of the respective tooth is between 10 nm and 1 mm.

4. The internal gear pump according to claim 2, wherein the at least one of an end-side surface and a crest face of the respective tooth defines a freeform surface that includes at least one spline, or a surface geometrically defined as a conically, cylindrically, or logarithmically profiled form.

5. The internal gear pump according to claim 1, wherein at least one of the first axial plate and the second axial plate defines a surface that is configured, at least in a region adjacent to the toothing, as a freeform surface that includes at least one spline, or a surface geometrically defined as a conically, cylindrically, or logarithmically profiled form.

6. The internal gear pump according to claim 2, wherein a length of the at least one of an end-side surface and a crest face of the respective tooth is from 10 μm to 1 mm.

7. The internal gear pump according to claim 6, wherein the at least one of an end-side surface and a crest face of the respective tooth is formed by at least one of lapping, grinding, turning, and turn milling.

8. The internal gear pump according to claim 1, wherein at least one of the first axial plate and the second axial plate is configured as a single-part disk.

9. A method of producing an internal gear pump for a hydraulic vehicle brake system, comprising:

positioning a pinion on a pump shaft so as to conjointly rotate therewith;

positioning a ring gear eccentrically relative to the pinion such that the pinion meshes with the ring gear; and positioning a first axial plate on the pump shaft on a first end side of the pinion and ring gear, and positioning a second axial plate on the pump shaft on a second end side of the pinion and ring gear such that the first axial plate and second axial plate delimit a pump chamber in an axial direction;

wherein at least one of the pinion and the ring gear includes a toothing configured such that an axial width of a root of a respective tooth is greater than an axial width of a crest of the respective tooth.

10. The method according to claim 9, wherein at least one of an end-side surface and a crest face of the respective tooth is formed by at least one of lapping, grinding, turning, and turn milling.

11. The internal gear pump according to claim 1, wherein at least one of the first axial plate and the second axial plate is configured as a multi-part disk.

* * * * *